United States Patent [19]

Metzger

[11] Patent Number: 4,899,896

[45] Date of Patent: Feb. 13, 1990

[54] CONTAINER PRESSURIZING APPARATUS

[76] Inventor: David A. Metzger, 146 Hickory Lake, Belleville, Ill. 62223

[21] Appl. No.: 178,329

[22] Filed: Apr. 6, 1988

[51] Int. Cl.[4] ..... B65D 51/24

[52] U.S. Cl. ..... 215/228; 141/88; 53/98

[58] Field of Search ..... 141/98, 4, 5, 11, 37, 141/69, 84, 46; 215/228; 53/88; 137/68.1, 538, 493, 493.9, 467, 513.5; 426/477; 99/323.1, 323.2

[56] References Cited

U.S. PATENT DOCUMENTS

| | | | |
|---|---|---|---|
| 280,798 | 7/1883 | Colcord . | |
| 377,520 | 2/1888 | Hutchins . | |
| 858,863 | 7/1907 | Farrand . | |
| 947,468 | 1/1910 | Fish . | |
| 985,598 | 2/1911 | Jeanson . | |
| 1,142,636 | 6/1915 | Singer . | |
| 1,328,866 | 1/1920 | Yeatter . | |
| 1,445,643 | 2/1923 | Peron . | |
| 1,460,208 | 6/1923 | Mohn . | |
| 1,479,496 | 1/1924 | Conwell . | |
| 1,968,316 | 7/1934 | Schmitt | 221/76 |
| 2,714,898 | 8/1955 | Reese | 137/799 |
| 3,198,405 | 8/1965 | Pfeil | 222/400.8 |
| 3,288,578 | 11/1966 | Witt | 137/467 X |
| 3,315,698 | 4/1967 | Harmes | 137/467 X |
| 3,409,037 | 11/1968 | Nelson | 137/467 X |
| 3,430,817 | 3/1969 | Falkenberg | 222/173 |
| 3,648,893 | 3/1972 | Whiting | 137/68.1 X |
| 3,901,272 | 8/1975 | Banners et al. | 137/513.5 |
| 4,022,347 | 5/1977 | Noble | 222/1 |
| 4,043,341 | 8/1977 | Tromovitch | 128/303.1 |
| 4,134,424 | 1/1979 | Zeyra et al. | 137/493 |
| 4,143,787 | 3/1979 | Walker | 137/467 X |
| 4,171,712 | 10/1979 | De Forrest | 137/513.5 |
| 4,178,960 | 12/1979 | Napolitano et al. | 137/467 X |
| 4,383,622 | 5/1983 | Guth | 222/209 |
| 4,434,810 | 3/1984 | Atkinson | 137/493 |
| 4,475,576 | 10/1984 | Simon | 141/98 |
| 4,524,877 | 6/1985 | Saxby et al. | 215/228 |
| 4,531,660 | 7/1985 | Ford, Jr. | 222/209 |
| 4,629,098 | 12/1986 | Eger | 222/175 |
| 4,640,426 | 2/1987 | Wasley | 215/228 |
| 4,663,803 | 8/1988 | Schneider | 215/228 X |
| 4,711,435 | 12/1987 | Harris et al. | 137/493 |
| 4,723,670 | 2/1988 | Robinson et al. | 215/228 |
| 4,763,802 | 8/1988 | Johnston | 215/228 |
| 4,768,665 | 9/1988 | Ballas | 215/228 |
| 4,773,444 | 9/1988 | Bleth et al. | 137/493 |

FOREIGN PATENT DOCUMENTS

| | | | |
|---|---|---|---|
| 3400283 | 7/1985 | Fed. Rep. of Germany | 215/228 |
| 1065526 | 5/1954 | France | 137/493.9 |
| 2343665 | 10/1977 | France | 215/228 |

*Primary Examiner*—Ernest G. Cusick

*Attorney, Agent, or Firm*—Senniger, Powers, Leavitt and Roedel

[57] ABSTRACT

A cap adapted for use in pressurizing the interior of a container for carbonated beverages, the container having an opening therein, the cap comprising a cap adapted for sealing engagement with the container for sealing closure of the opening, a boss projecting from the cap for connecting a pressurizing device to the cap, a passage in the boss for providing communication between the pressurizing device and the interior of the container when the cap is on the container, the pressurizing device being operable to introduce gas via the passage into the interior of the container to pressurize it, and a single check valve in the passage. The check valve is adapted for permitting flow of gas from the pressurizing device into the interior of the container via the passage, for blocking flow of gas out of the container via the passage when the pressure in the container is below a predetermined limit, and for permitting flow out of the container via the passage when the pressure reaches or exceeds the predetermined limit.

6 Claims, 1 Drawing Sheet

CONTAINER PRESSURIZING APPARATUS

BACKGROUND OF THE INVENTION

This invention relates to pressurizing devices and, more particularly, to apparatus for pressurizing the interior of a container having a carbonated beverage therein.

A longstanding problem associated with large containers of carbonated beverages such as soda, for example, is that once the container is opened, the beverage therein generally loses its carbonation and becomes "flat." Resealing the container after use does not solve the problem, because the carbonation still tends to escape from the liquid into the emptied interior of the container above the liquid.

Reference may be made to U.S. Pat. Nos. 377,520, 2,714,898 and 4,629,098 disclosing container pressurizing devices and liquid dispensers generally in the field of this invention. It will be noted, however, that such devices do not address the problem of maintaining the carbonation of liquid within the container when the container is closed.

SUMMARY OF THE INVENTION

Among the several objects of this invention may be noted the provision of apparatus for pressurizing a container, such as a container of carbonated beverage, to prevent the beverage from becoming flat between uses; the provision of such apparatus which reduces the likelihood of overpressurizing the interior of a container; and the provision of such a device which is easy to use and economical to manufacture.

Generally, a cap of the present invention adapted for use in pressurizing the interior of a container for carbonated beverages, the container having an opening therein. The cap comprises a generally cylindric body adapted for enagagement with the container, at the opening for sealing closure of the opening, and is adapted for connection of a pressurizing device to the body, a passage in the body for providing communication between the pressurizing device and the interior of the container when the body is on the container, the pressurizing device being operable to introduce gas via the passage into the interior of the container to pressurize it, and a single check valve in the passage adapted for permitting flow of gas from the pressurizing device into the interior of the container via the passage, for blocking flow of gas out of the container via the passage when the pressure in the container is below a predetermined limit, and for permitting flow out of the container via the passage when the pressure reaches or exceeds the predetermined limit.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
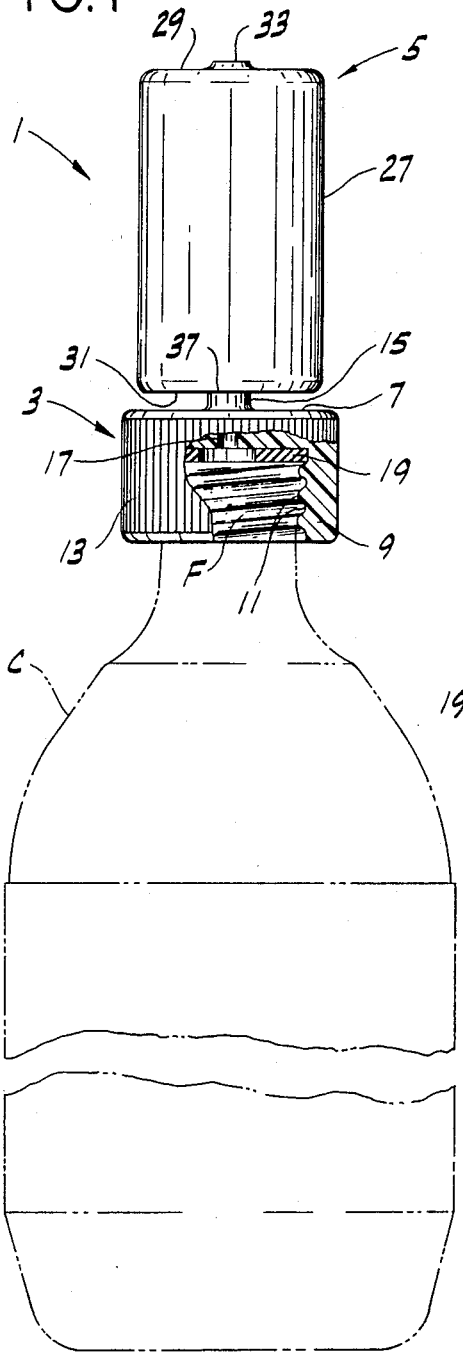
FIG. 1 is a view illustrating pressurizing apparatus of this invention attached to a container (in phantom), portions of the apparatus being broken away to show engagement of the apparatus with the container.

Referring to the drawings, particularly FIG. 1, there is generally indicated at 1, apparatus of the present invention for pressurizing the interior of a container C (e.g., a plastic bottle) for carbonated beverage, such as soda, the container having a threaded finish F defining an opening in the container. As illustrated, this apparatus generally comprises a cap, generally designated 3, and a pressurizing device, generally designated 5, which is adapted to be connected to the cap and which is operable to introduce gas (e.g., air) into the interior of the container to pressurize it. As will be described, the cap 3 is adapted to block flow of gas out of the container C through the cap unless the pressure in the container reaches or exceeds a predetermined limit. Thus, apparatus 1 enables the interior of the container C to be pressurized, but only to a certain point to avoid excessive pressure buildup.

The cap 3 includes generally cylindric body comprising top wall 7, a depending side wall 9 and an open bottom. The side wall 9 of the cap is formed with internal helical threads 11 enabling the cap to be screwed on finish F of the container C for sealing closure of the opening in the container C. The cap 3 has a knurled exterior 13 to facilitate gripping when the cap is screwed on and off the container C. Projecting upwardly from the top of the cap 3 is a relatively long slender boss 15 which is integral with the cap, 15 boss 15 having a generally uniform diameter axial passage 17 therethrough and through the top wall 7. When the cap 3 is screwed onto container C, the passage 17 provides communication between the interior of the container and the pressurizing device 5, as will be explained hereinafter.

A thin flat washer 19 formed of resilient water-resistant material or the like is provided on the underside of the top wall 7 of the cap. The periphery of the washer 19 engages the side wall 9 so that, when the cap 3 is screwed onto the container C, the washer 19 engages the rim of the finish F and is compressed thereagainst to create a seal around the mouth of the container. The interior hole 21 in the washer 19 is larger than the diameter of the passage 17 to permit flow into or out of the container C via the passage.

Disposed within the passage 17 is a single check valve member 23 which allows flow V therethrough in one direction but blocks flow therethrough in the opposite direction. The check valve member 23 is oriented in the passage 17 so that the unimpeded direction of flow V through the valve is into the container C. The body 25 of the member 23 has a cross-sectional shape which corresponds to that of the passage 17 and a cross-sectional size which enables the valve to have a sealing slip fit in the passage. The fit between the member body 25 and the passage 17 is sufficiently tight to prevent the check valve member 23 from being forced up and out of the passage by the pressure inside the container C so long as the pressure is below a predetermined limit. The member 23 thus maintains higher than ambient pressure in the container. The fit, however, is sufficiently loose that the check valve member 23 will slip up and out of the passage 17 if the pressure in the container C reaches or exceeds the predetermined limit. Thus, check valve member 23 blocks the flow of gas out of the container C via the passage 17 when the pressure in the container is below a predetermined limit but allows flow out of the container when the pressure inside the container reaches or exceeds the predetermined limit. Containment of the pressurization inside the container C is thereby facilitated while preventing pressurization of the container above a certain point.

Figure 2:
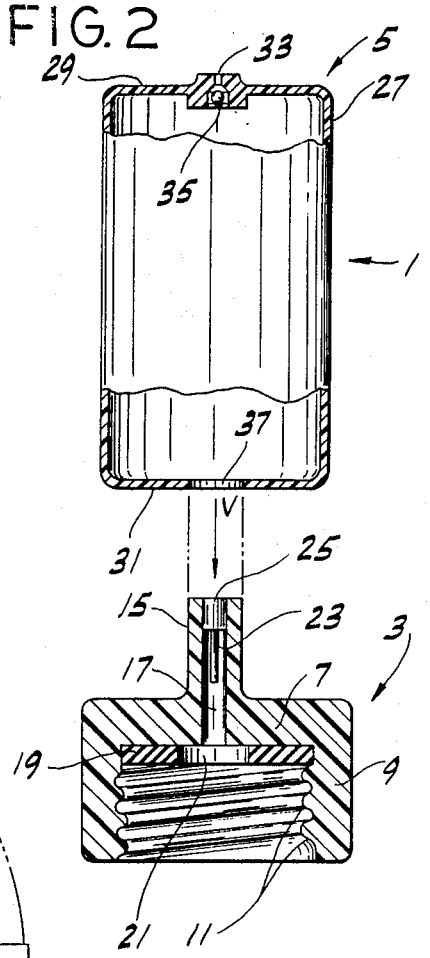
FIG. 2 is an enlarged portion of FIG. 1 showing an exploded view of the apparatus and sectional views of various parts.

The pressurizing device 5 includes a compressible hollow bulb 27 of resilient material such as rubber or the like having a generally cylindrical shape with top and bottom walls 29,31. The bulb 27 is relativxely small so as to be easily carried in one hand. An inlet 33 in the top wall 29 provides communication between the ambient surroundings and the interior of the bulb 27. A check valve 35 is disposed in the inlet 33 permitting flow of air into the interior of the bulb 27 via the inlet but blocking flow of air out of the bulb via the inlet. The bulb 27 has an opening in its bottom wall 31 constituting an outlet 37. This outlet 37 is sized to slidingly receive the boss 15 of the cap as shown in FIG. 2. The bulb 27 is releasably connected to the cap 3 by forcing it down on the boss 15 for a sealing and releasable interference fit with the cap, thereby enabling communication between the interior of the bulb and the interior of the container C via the passage 17. The bulb 27 may be released from its connection to the cap 3 by pulling the bulb upward with sufficient force to disengage the bulb from the boss 15 of the cap 3. A collar of resilient material (not shown) may be attached to the periphery of the outlet 37 to produce a tight seal between the boss 15 and the collar when the boss is received therein. Compression of the bulb 27, when connected to the cap 3, will create a flow of pressurized air into the interior of the container C. It will be understood that other pressure sources may be used and still fall within the scope of this invention.

The sliding fit between the boss 15 and the bulb 27 enables quick and easy attachment and removal of the bulb to and from the cap 3. Thus, the bulb 27 may be used to pressurize any number of containers having caps 3 installed thereon.

It will be understood that the apparatus of the present invention is not limited to pressurizing containers having carbonated beverages therein as it may be used to pressurize other containers. The apparatus is especially useful in applications in which the pressurization is desired to be maintained within certain limits.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A cap in combination with a pressurizing device for pressurizing the interior of a container for carbonated beverages, the container having a threaded finish defining an opening therein, the cap comprising a generally cylindric body having a top wall and a depending side wall, and internal threads for screwing the body onto the container, the body being formed for releasable connection of said pressurizing device thereto, a seal underlying the top wall of the body adapted for sealing engagement with the finish of the container when the cap is screwed onto the container, a passage in the body for providing communication between said pressurizing device and the interior of the container when the body is on the container, said body having a relatively long slender boss projecting up from the top wall of the body, and wherein the passage is of generally uniform diameter and extends axially of the boss and through the top wall of the body, said pressurizing device being adapted for releasable connection with the boss and being operable to introduce gas via said passage into the interior of the container to pressurize it, and a single check valve member in said passage adapted for permitting flow of gas from said pressurizing device into the interior of the container via said passage, for blocking flow of gas out of the container via said passage when the pressure in the container is below a predetermined limit, and for permitting flow out of the container via said passage when said pressure reaches or exceeds said predetermined limit.

2. The cap as set forth in claim 1 wherein said check valve member has a sealing slip fit in said passage, the fit being sufficiently tight to maintain the check valve member in said passage when the pressure in the container is below said predetermined limit, but sufficiently loose that the check valve member is adapted to slip out of the passage in the event the pressure in the container reaches or exceeds said limit.

3. Apparatus for pressurizing and maintaining pressure in a container for carbonated beverages, the container having a threaded finish defining an opening therein, the apparatus comprising, a pressurizing device for introducing air into the interior of the container to pressurize it, a cap having a top wall, a relatively long slender boss projecting up from the top wall, a side wall depending from the top wall and internal threads adapted to engage the threaded finish of the container at said opening for screwing the cap onto the container, the cap being formed for releasable connection of said pressurizing device thereto, a seal underlying the top wall of the cap, the seal being adapted for sealing engagement with the finish of the container when the cap is screwed onto the container, a passage in the cap for providing communication between said pressurizing device and the interior of the container when the cap is on the container, the passage being of generally uniform diameter and extending axially of the boss and through the top wall of the cap, said pressurizing device being adapted for releasable connection with the boss for introducing gas into the container via said passage, and a single check valve member in said passage adapted for permitting flow of gas from said pressurizing device into the interior of the container via said passage, for blocking flow of gas out of the container via said passage when the pressure in the container is below a predetermined limit, and for permitting flow out of the container via said passage when said pressure reaches or exceeds said predetermined limit.

4. Apparatus as set forth in claim 3 wherein said check valve member has a sealing slip fit in said passage, the fit being sufficiently tight to maintain the check valve member in said passage when the pressure in the container is below said predetermined limit, but sufficiently loose that the check valve member is adapted to slip out of the passage in the event the pressure in the container reaches or exceeds said limit.

5. Apparatus for pressurizing the interior of a container for carbonated beverages, the container having an opening therein, the apparatus comprising a pressurizing device for introducing air into the interior of the container to pressurize it, said pressurizing device comprising a compressible hollow bulb of resilient material having an inlet adapted to communicate with ambient surroundings, a check valve in the inlet adapted for permitting flow of air into the interior of said bulb via said inlet and for blocking flow of air out of said bulb via said inlet, and an outlet, a cap adapted for sealing engagement with the container at said opening for sealing closure of said opening, the cap being formed for releasable connection of the bulb thereto, a passage in the cap for providing communication between the bulb and the interior of the container when the cap is on the container, the bulb at its outlet being adapted for a sealing and sliding friction fit with the cap at said passage to releasably connect the bulb and the cap, whereby compression of the bulb will pump air into the interior of the container via said passage, and a single check valve member in said passage adapted for permitting flow of gas from the bulb into the interior of the container via said passage, for blocking flow of gas out of the container via said passage when the pressure in the container is below a predetermined limit, and for permitting flow out of the container via said passage when said pressure reaches or exceeds said predetermined limit.

6. Apparatus for pressurizing and maintaining pressure in a container for carbonated beverages, the container having an opening therein and a threaded finish generally at said opening, the apparatus comprising a cap having internal threads adapted for threaded engagement with the finish of the container over said opening for sealing closure of said opening, the cap having a top wall and a relatively long slender boss projecting up from the top wall of the cap, a pump made of resilient material having an inlet adapted to communicate with ambient surroundings, a check valve in the inlet adapted for permitting flow of air into the interior of the pump via said inlet and for blocking flow of air out of the pump via said inlet, and an outlet permitting flow out of the pump, the pump being relatively small so as to be easily carried in one hand a passage in the cap for providing communication between the pump and the interior of the container, said passage extending axially of the boss and through the top wall of the body, the pump slidingly receiving an upper portion of the boss in said outlet with a sealing friction fit between the boss and the pump at said outlet to quickly and releasably connect the pump to the cap whereby said pump may be used to pressurize several containers each having a cap thereon, the pump being operable to introduce air into the interior of the container through the passage by manually compressing the pump to collapse a volume enclosed by the pump, means for permitting flow of air from the pump into the interior of the container via said passage, and for blocking flow of air out of the container via said passage.

* * * * *